United States Patent [19]

Kelley

[11] Patent Number: 4,673,374

[45] Date of Patent: Jun. 16, 1987

[54] ARTICULATED LIMB ASSEMBY FOR FIGURE TOY

[75] Inventor: William Kelley, Torrance, Calif.

[73] Assignee: Mattel, Inc., Hawthorne, Calif.

[21] Appl. No.: 821,950

[22] Filed: Jan. 24, 1986

[51] Int. Cl.[4] ..... A63H 3/46

[52] U.S. Cl. ..... 446/383

[58] Field of Search ..... 446/383, 378, 376, 380, 446/381, 379, 390, 371, 375

[56] References Cited

U.S. PATENT DOCUMENTS

| | | | |
|---|---|---|---|
| 1,709,432 | 4/1929 | Hill | 446/371 |
| 2,129,421 | 9/1938 | Hales . | |
| 2,632,586 | 3/1953 | Barrango | 223/68 |
| 2,649,806 | 8/1953 | Monaghan . | |
| 2,663,971 | 12/1953 | Ippolito . | |
| 2,925,684 | 2/1960 | Hausser et al. . | |
| 3,147,566 | 9/1964 | Ong . | |
| 3,234,689 | 2/1966 | Ryan . | |
| 3,277,601 | 10/1966 | Ryan . | |
| 3,350,812 | 11/1967 | Lindsay et al. . | |
| 3,357,610 | 12/1967 | Quinby, Jr. | 223/68 |
| 3,611,625 | 10/1971 | Sloop et al. . | |
| 3,628,282 | 12/1971 | Johnson et al. . | |
| 3,648,405 | 3/1972 | Tepper . | |
| 3,701,215 | 10/1972 | Marason, Jr. et al. . | |
| 3,713,252 | 1/1973 | Bear et al. . | |
| 3,716,942 | 2/1973 | Garcia et al. . | |
| 3,731,426 | 5/1973 | Lewis et al. . | |
| 3,928,934 | 12/1975 | Lewis et al. | 446/378 X |
| 3,986,295 | 10/1976 | Keller . | |
| 3,988,855 | 11/1976 | Crabtree et al. . | |
| 3,994,092 | 11/1976 | Sapkus et al. . | |
| 4,186,517 | 2/1980 | Kuhn et al. . | |
| 4,268,991 | 5/1981 | Cotey et al. . | |
| 4,274,224 | 6/1981 | Pugh et al. | 446/383 X |
| 4,279,099 | 7/1981 | Dyer et al. . | |
| 4,596,532 | 6/1986 | Cook et al. | 446/379 X |

*Primary Examiner*—Mickey Yu

*Attorney, Agent, or Firm*—Ronald M. Goldman; Melvin A. Klein; Daniel F. Sullivan

[57] ABSTRACT

An articulated limb assembly for a figure toy which allows the limbs of the figure toy to be rotated about three different axes for the purpose of posing the limbs. The assembly includes a supporting track mounted within the hollow torso of the figure toy which is used to guide connectors coupled to the limbs. Heads attached to the connectors frictionally engage curve surfaces of the track allowing each limb to be rotated about a vertical axis. Each limb may also be frictionally rotated about a first horizontal axis or about the longitudinal axis of one of the connectors. Disk members attached to the connectors frictionally engage slots in the limbs allowing each limb to be frictionally rotated about a second horizontal axis. As a result, the limbs of the figure toy may be posed in a variety of different positions.

6 Claims, 4 Drawing Figures

ARTICULATED LIMB ASSEMBY FOR FIGURE TOY

CROSS-REFERENCE TO RELATED APPLICATION

The subject matter of this application is related to the subject matter of U.S. patent application Ser. No. 682,022, filed Dec. 14, 1984 by Phedon J. Tsiknopoulos and Roger H. Sweet for an "Animated Figure Having a Rotatable Torso," and assigned to Mattel, Inc., the assignee of the instant application.

BACKGROUND OF THE INVENTION

The present invention relates generally to articulated limbs for figure toys and, more particularly, to an articulated limb assembly for a figure toy which allows an articulated limb to be rotated about three different axes for the purpose of posing the limb.

In the past, figure toys have used a variety of joints for the purpose of allowing articulated limbs to be moved or rotated in different ways. For example, a number of U.S. patents disclose articulated limbs coupled to the torso of figure toys in order to allow the limbs to be rotated about one axis: U.S. Pat. Nos. 4,268,991 issued to Cotey et al on May, 26, 1981; 4,186,517 issued to Kuhn et al on Feb. 5, 1980; 3,994,092 issued to Sapkus et al on Nov. 30, 1976; 3,986,295 issued to Keller on Oct. 19, 1976; 3,731,426 issued to Lewis et al on May 8, 1973; 3,713,252 issued to Bear et al on Jan. 30, 1973; 3,648,405 issued to Tepper on Mar. 14, 1972; 3,611,625 issued to Sloop et al on Oct. 12, 1971; 3,277,601 issued to Ryan on Oct. 11, 1966; 3,147,566 issued to Ong on Sept. 8, 1964; 2,925,684 issued to Hausser et al on Feb. 23, 1960; and 2,663,971 issued to Ippolito on Dec. 29, 1953. Other U.S. patents disclose articulated joints which rotate about two axes: U.S. Pat. Nos. 4,279,099 issued to Dyer et al on July 21, 1981; 3,988,855 issued to Crabtree et al on Nov. 2, 1976; 3,701,215 issued to Marason, Jr. et al on Oct. 31, 1972; 3,628,282 issued to Johnson et al on Dec. 21, 1971; 3,357,610 issued to Quinby, Jr. on Dec. 12, 1967; 3,350,812 issued to Lindsay et al on Nov. 7, 1967; 3,234,689 issued to Ryan on Feb. 15, 1966; and 2,632,586 issued to Barrango on Mar. 24, 1953.

U.S. Pat. No. 2,129,421 issued to Hales on Sept. 6, 1938 discloses the use of ball and socket joints located inside a manikin made out of sponge rubber or similar elastic material. A variety of different manikin joints are described in U.S. Pat. No. 2,649,806 issued to Monaghan on Aug. 25, 1953. U.S. Pat. No. 3,716,942 issued to Garcia on Feb. 20, 1973 discloses an articulated arm coupled to the torso of a figure toy so that the arm may be rotated about two axes adjacent the shoulder portion of the torso. An armature provided with a tensioned, detented connector was located inside a portion of the arm permitting rotation about the longitudinal axis of that portion of the arm.

None of the above patents discloses an economical articulated limb assembly which allows the articulated limbs of a hollow figure toy to be rotated about three axes adjacent to where the limbs are coupled to the hollow torso of the figure toy. Such an assembly would be particularly useful for the purpose of coupling articulated plastic limbs to the hollow plastic torso of a figure toy. Limbs coupled in this manner may be rotated about three different axes for the purpose of posing the limbs.

SUMMARY OF THE INVENTION

It is an object of this invention to provide a new and improved articulated limb assembly whch may be used for figure toys.

It is another object of this invention to provide a new and improved articulated limb assembly which allows the articulated limbs of a figure toy to be rotated about three different axes.

It is still another object of this invention to provide a new and improved articulated limb assembly which allows the articulated limbs of a hollow figure to be rotated about three axes adjacent to where the limbs are coupled to the hollow torso of the figure toy for the purpose of posing the limbs.

These and other objects and advantages are attained by an articulated limb assembly that allows the limbs of a figure toy to be rotated about three different axes for the purpose of selectively posing the limbs in a variety of different positions. The assembly includes a supporting track mounted within the hollow torso of the figure toy which is used to guide connections coupled to the limbs. Heads attached to the connectors frictionally engage curved surfaces of the track allowing each limb to be rotated about a vertical axis. Each limb may also be frictionally rotated about a first horizontal axis or about the longitudinal axis of one of the connectors. Disk members attached to the connectors frictionally engage slots in the limbs allowing each limb to be frictionally rotated about a second horizontal axis. As a result, the limbs of the figure toy may be posed in numerous positions.

The various features of the present invention will be best understood, together with futher objects and advantages by reference to the following description of the preferred embodiment, taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Figure 1:
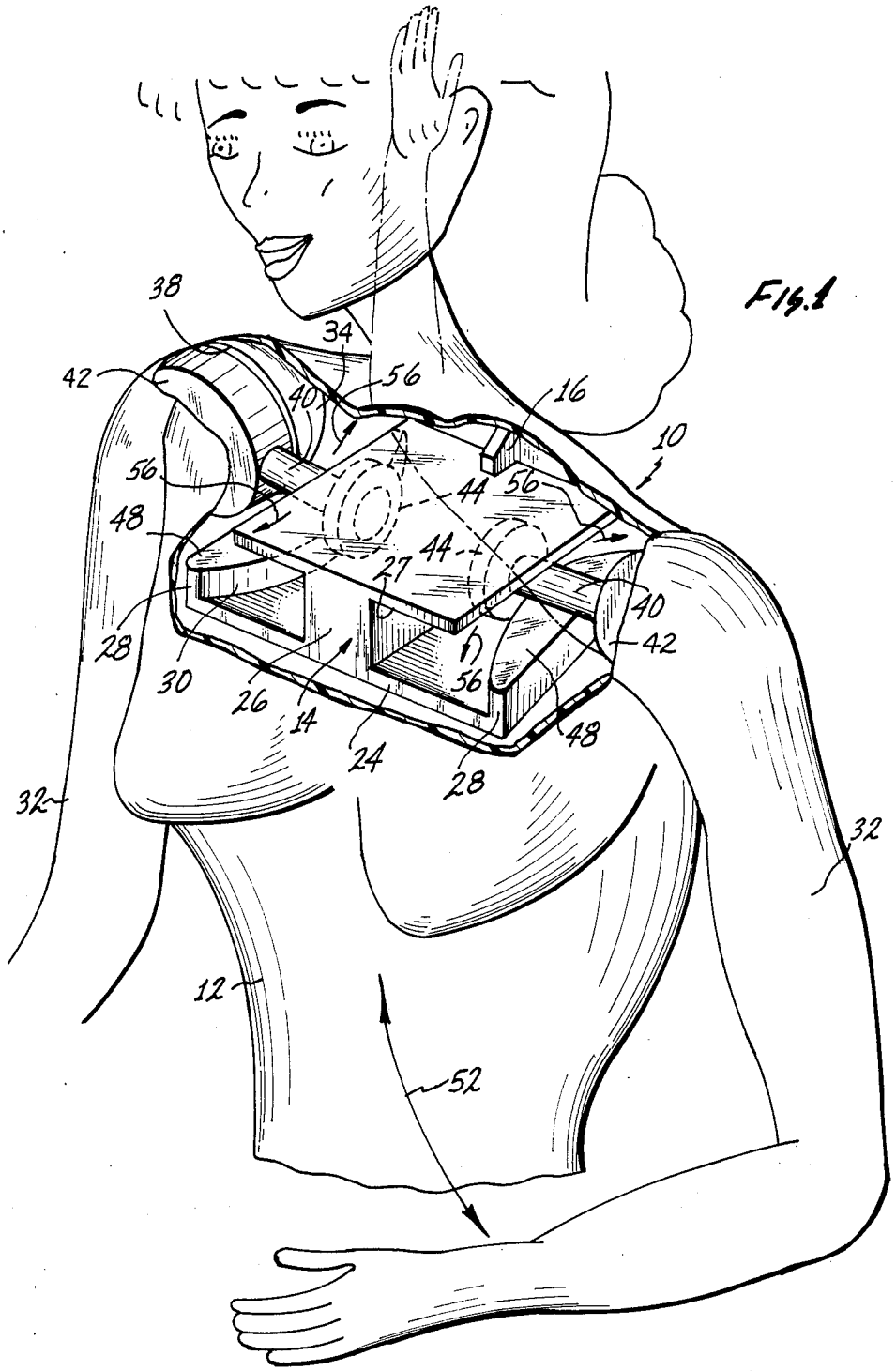
FIG. 1 is a perspective view of a figure toy with part of the torso of the figure toy broken away to show the articulated limb assembly of this invention.
Figure 2:
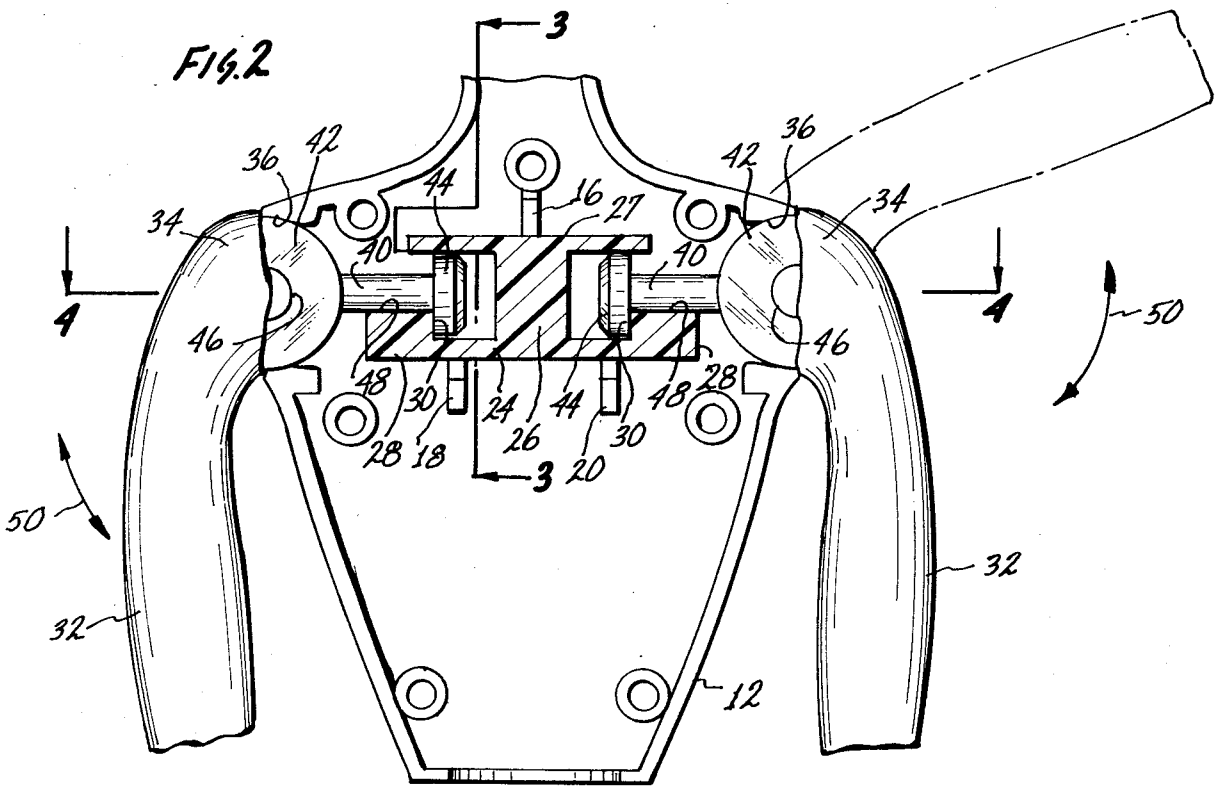
FIG. 2 is a front view of the inside of the figure toy with part of two upper portions of the figure toy's arms broken away showing a supporting track of the articulated limb assembly in cross-section.
Figure 3:
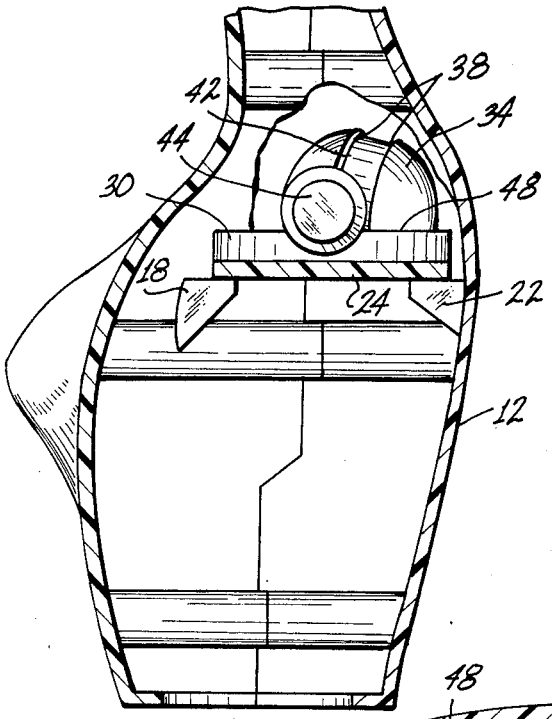
FIG. 3 is a cross-sectional view of the figure toy and articulated limb assembly taken along line 3—3 of FIG. 2.

Referring now to the drawings and particularly to FIGS. 1 and 2, a preferred embodiment of the articulated limb assembly 10 of the present invention is shown mounted on the hollow torso 12 of a figure toy. The assembly 10 includes a supporting track 14 which is mounted to the inside of the torso 12. FIGS. 1–3 show the track 14 supported by a plurality of supporting members 16, 18, 20 and 22. However, any conventional means of supporting the track 14 may be used.

The supporting track 14 includes a bottom plate 24 having an upwardly extending middle portion 26 and two upwardly extending curved portions 28. Each of the curved portions 28 has a curved surface 30 at one side thereof. A top plate 27 is attached to the middle portion 26 as shown in FIGS. 1 and 2. The top plate 27 is preferably generally parallel to the bottom plate 24.

Figure 4:
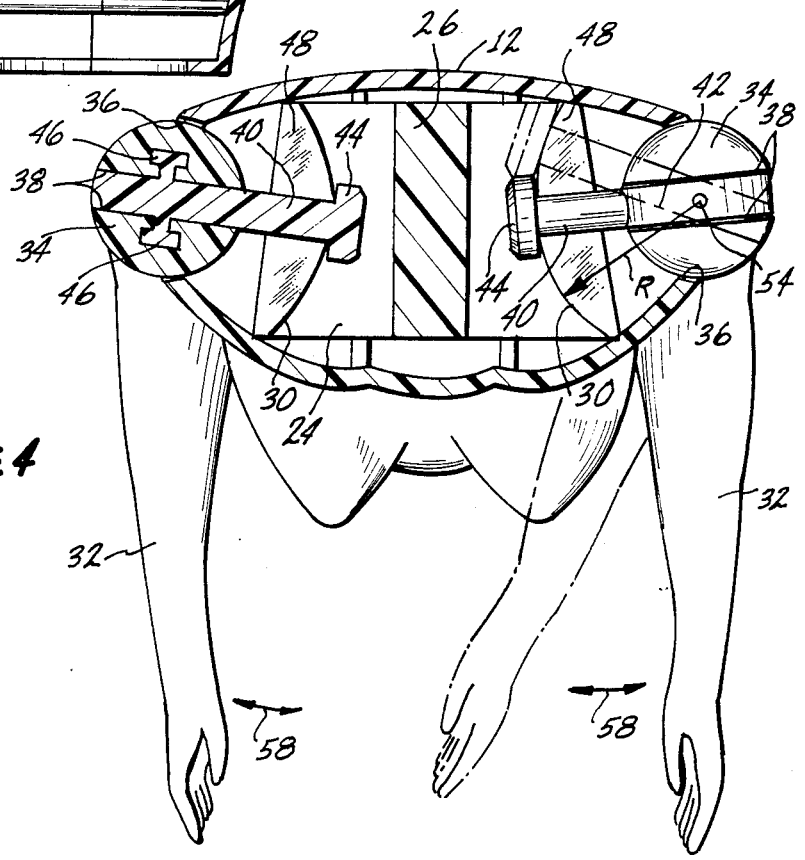
FIG. 4 is a top partial cross-sectional view of the figure toy and articulated limb assembly taken along line 4—4 of FIG. 2.

The figure toy has two arms 32 with generally spherically-shaped upper portions 34 which operably engage apertures 36 in the shoulder portions of the torso 12 as best shown in FIG. 4. The upper portions 34 are free to rotate within the apertures 36. Each upper portion 34 has a slot 38 therein. Two connectors 40 are used to couple the upper portions 34 of the arms 32 to the supporting track 14. The connectors 40 have disk members 42 (see FIG. 2) at one end which engage the slots 38 in the upper portions 34 of the arms 32 and heads 44 at the other end which engage the curved portions 28 of the supporting track 14.

As shown in FIG. 4, each disk member 42 has extensions 46 (see also FIG. 2) which are preferably T-shaped and molded as integral parts of the member. The upper portions 34 of the arms 32 are preferably molded about the disk members 42 and extensions 46 during an insert molding operation. As a result, the disk members 42 are free to frictionally rotate within the slots 38 and the extensions 46 are free to frictionally rotate within upper portions 34. The upper portions 34 of the arms are also free to frictionally rotate in apertures 34. The disk members 42 and extentions 46 rotate about common axes perpendicular to the flat sides of the members 42 (horizontal axes when the assembly 10 is orientated as shown in FIGS. 1–4). Therefore, since the upper portions 34 are free to frictionally rotate relative to the disk members 42 and extentions 46, the arms 32 of the figure toy may be moved up and down to desired posed positions as illustrated by arrows 50 shown in FIG. 2.

Referring again to FIG. 2, the connectors 40 contact top surfaces 48 of the curved portions 28 and the heads 44 contact the curved surfaces 30 of portions 28 when the arms 32 are moved upward. Also, the connectors 40 contact the top surfaces 48 and the heads 44 contact the top plate 27 when the arms 32 are moved downward. Note that the upper portions 34 of the arms 32 are kept engaged in apertures 36 by the heads 44 which contact curved surfaces 30 when someone attempts to pull the arms 32 from the torso 12.

The arms 32 may also be rotated 360 degrees about the longitudinal axes of the connectors 40 to selected posed positions as illustrated by arrows 52 shown in FIG. 1. This is possible because the upper portions 34 of the arms are free to frictionally rotate in apertures 36 and the heads 44 are free to frictionally rotate while in contact with curved surfaces 30. As such, the arms 32 may be rotated about the axes of the connectors 40 to any desired posed position.

As best shown in FIG. 4, each upper portion 34 may be frictionally rotated in apertures 36 about a vertical axis passing through point 54 and the center of the spherically-shaped portion 34. The curved surfaces 30 are formed or shaped to have a radius R as shown in FIG. 4. As the upper portion 34 rotates, its corresponding connector 40 also rotates about the vertical axis passing through point 54 (see arrows 56 shown in FIG. 1). This rotation causes head 44 to move along an arc defined by radius R or to frictionally slide along curved surface 30. In essence, curved surface 30 acts as a track for the purpose of guiding or controlling the rotation of each upper portion 34 or arm 32. As a result, the arms 32 are free to selectively move to desired posed positions as illustated by arrows 58 shown in FIG. 4.

In summary, the arms 32 may be rotated about three different axes for the purpose of selectively moving the arms in the direction of arrows 50, 52 and 58. Since the arms 32 frictionally rotate about the three axes, they may be conveniently posed in a variety of different positions. It is important to note that the articulated limb assembly of this invention may be used to pose limbs other than arms such as legs. Also, the assembly may be used for posing a single limb.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

I claim:

1. An articulated limb assembly for a figure toy having a hollow torso with a plurality of apertures comprising:

a supporting track mounted inside said hollow torso including a bottom plate, two curved portions extending upwardly from said bottom plate, a middle portion extending upwardly from said bottom plate and a top plate attached to said middle portion, each of said curved portions having a curved surface;

two limbs each having a generally spherically-shaped upper portion rotatably engaging one of said apertures in said hollow torso, each of said upper portions having a slot therein; and two connectors operably coupled to said two limbs and to said supporting track, each of said two connectors having a head attached to one end thereof and a disk member attached to the other end thereof, each of said disk members rotatably engaging said slot in one of said upper portions so that each of said upper portions is capable of rotating about a first horizontal axis, each of said heads frictionally engaging said curved surface of one of said curved portions so that each of said upper portions and each of said connectors are capable of rotating about a common vertical axis and about a common second horizontal axis, each of said common second horizontal axes being perpendicular to one of said vertical axes and to one of said first horizontal axes and coinciding with a longitudinal axis of one of said connectors.

2. The articulated limb assembly of claim 1 wherein each of said curved surfaces of said curved portions is defined by a radius having a center located on one of said vertical axes.

3. An articulated limb assembly for a figure toy having a hollow torso with a plurality of apertures comprising:

at least one limb, said at least one limb having an upper portion rotatably engaging one of said apertures in said hollow torso;

connector means for controlling rotation of said upper portion about a vertical axis and first and second horizontal axes, said connector means including a connector having a head attached to one end thereof and a disk member attached to the other end thereof, said disk member rotatably engaging said upper portion; and supporting track means for supporting and guiding said connector means including a bottom plate, at least one curved portion extending upwardly from said bottom plate, a middle portion extending upwardly from said bottom plate and a top plate attached to said middle portion, said at least one curved portion having a curved surface frictionally engaging said head of said connector.

4. The articulated limb assembly of claim 3 wherein said vertical and horizontal axes are perpendicular and disposed at right angles to each other.

5. The articulated limb assembly of claim 4 wherein said upper portion has a slot therein, said disk member rotatably engaging said slot.

6. An articulated limb assembly for a figure toy having a hollow torso with a plurality of apertures comprising:

at least one limb, said at least one limb having an upper portion rotatably engaging one of said apertures in said hollow torso, said upper portion having a slot therein;

connector means rotatably engaging said upper portion for controlling rotation of said upper portion about three perpendicular axes, said connector means including a connector having a head attached to one end thereof and a disk member attached to the other end thereof, said disk member rotatably engaging said slot in said upper portion; and supporting track means frictionally engaging said connector means and mounted inside said hollow torso for supporting and guiding said connector means so that said upper portion is capable of rotating about said axes, said supporting track means including a bottom plate, at least one curved portion extending upwardly from said bottom plate, a middle portion extending upwardly from said bottom plate and a top plate attached to said middle portion, said curved portion having a curved surface frictionally engaging said head of said connector.

* * * * *